US008414827B2

(12) United States Patent
Lee

(10) Patent No.: US 8,414,827 B2
(45) Date of Patent: Apr. 9, 2013

(54) POROUS LIGHT WEIGHT IRON AND METHOD FOR PREPARING THE SAME

(75) Inventor: Se-Lin Lee, Chungcheongnam-do (KR)

(73) Assignee: Se-Lin Lee, Chungcheongnam-do (KR)

( * ) Notice: Subject to any disclaimer, the term of this patent is extended or adjusted under 35 U.S.C. 154(b) by 0 days.

(21) Appl. No.: 12/745,121

(22) PCT Filed: Dec. 1, 2008

(86) PCT No.: PCT/KR2008/007083

§ 371 (c)(1),
(2), (4) Date: Jun. 16, 2010

(87) PCT Pub. No.: WO2009/069985

PCT Pub. Date: Jun. 4, 2009

(65) Prior Publication Data

US 2010/0303663 A1 Dec. 2, 2010

(30) Foreign Application Priority Data

Nov. 30, 2007 (KR) ..... 10-2007-0124008

(51) Int. Cl.
*B22F 3/11* (2006.01)

(52) U.S. Cl. ..... 419/2; 419/8; 75/228; 75/246

(58) Field of Classification Search ..... 419/2, 11, 419/14; 75/245–248
See application file for complete search history.

(56) References Cited

U.S. PATENT DOCUMENTS 2,110,066 A * 3/1938 Heuer ..... 75/467
2,467,528 A * 4/1949 Hauser ..... 419/34
3,899,320 A * 8/1975 Benecke et al. ..... 75/504
4,350,523 A 9/1982 Taguchi et al.
4,472,351 A * 9/1984 Gonczy ..... 419/46

(Continued)

FOREIGN PATENT DOCUMENTS

KR 102000000464 A 1/2000
KR 1020070047526 A 5/2007
WO 03070401 A1 8/2003

OTHER PUBLICATIONS

Written Opinion of the International Searching Authority in International Patent Application No. PCT/KR2008/007083, Mailing Date: Apr. 30, 2009.

*Primary Examiner* — Maria Veronica Ewald
*Assistant Examiner* — Megha Mehta
(74) *Attorney, Agent, or Firm* — Tristan A. Fuierer; Andrew D. Gerschutz; Moore & Van Allen, PLLC

(57) ABSTRACT

The present invention relates to a porous lightweight iron and a method for preparing the same, and more particularly to a porous lightweight iron having decreased weight due to pores formed therein while having a strength similar to that of existing steel products; and a method for preparing a porous lightweight iron having desired properties or various properties according to intended use. As described above in detail, according to the present invention, the thickness, weight and strength of lightweight iron to be produced, can be controlled, thus making it possible to prepare porous lightweight iron having desired properties by controlling the sintering temperature during the preparation process, the mixing ratio of diamond or silicon carbide and the mixing ratio of raw materials. Also, since the porous lightweight iron prepared according to the present invention has a weight per unit volume of 10 to 65% (W/V), compared to the existing iron steel products, it is possible to increase economic efficiency and improve processing convenience, when applied to an actual industry.

1 Claim, 3 Drawing Sheets

U.S. PATENT DOCUMENTS 4,505,746 A * 3/1985 Nakai et al. ..... 75/243
4,636,253 A * 1/1987 Nakai et al. ..... 75/239
4,690,320 A * 9/1987 Morishita et al. ..... 228/194
7,261,141 B2 8/2007 Nakajima
2002/0170391 A1 11/2002 Knott et al.

* cited by examiner

POROUS LIGHT WEIGHT IRON AND METHOD FOR PREPARING THE SAME

CROSS-REFERENCE TO RELATED APPLICATIONS

This application is filed under the provisions of 35 U.S.C. §371 and claims the priority of International Patent Application No. PCT/KR2008/007083 filed on 1 Dec. 2008 entitled "Porous Light Weight Iron and Method for Preparing the Same" in the name of Se-Lin Lee, which claims priority of Korean Patent Application No. 10-2007-0124008 filed on 30 Nov. 2007, both of which are hereby incorporated by reference herein in their entirety.

TECHNICAL FIELD

The present invention relates to porous lightweight iron and a method for preparing the same, and more particularly to porous lightweight iron having decreased weight due to pores formed therein while having a strength similar to that of existing steel products; and a method for preparing porous lightweight iron having desired properties or various properties according to intended use.

BACKGROUND ART

Generally, "porous materials", which refer to materials with a pore volume of 10 to 98% based on the total volume, have properties such as impact energy absorption capability, gas and liquid permeability, sound shield, low thermal conductivity, electrical insulation and the like due to pores therein and thus, have been widely used as impact absorbing materials, filters, sound shielding materials, insulators and are also expected to be commercially utilized in more fields. Also, the porous materials are expected to be applied as a lightweight structure, a core material of sandwich structure and the like. Examples of porous metal and alloy materials known in the prior art include aluminum (Al), magnesium (Mg), zinc (Zn), iron (Fe), lead (Pb), gold (Au), silver (Ag), zirconium (Zr), copper (Cu), nickel (Ni), titanium (Ti), cobalt (Co), nickel-chromium (Ni—Cr) alloy and stainless steel and the like.

The porous metal and alloy materials are used in various fields. Specifically, examples of materials used as impact absorbing materials and structural materials include aluminum (Al), copper (Cu), Nickel (Ni) and the like, examples of materials used as filtering materials include copper (Cu), stainless steel, gold (Au) and Nickel (Ni) and examples of materials used as sound shielding materials include copper (Cu).

However, due to the demand for high performance and quality improvement in the aeronautics and space fields, the automobile fields, the industrial mechanical fields, the electrical and electronics fields, requirements for porous materials are becoming complicated and thus there are limitations in applying the existing porous metal and alloy materials to the above mentioned fields.

As an example of pore-containing metal, a metal porous body (WO 2003/070401) was recently disclosed. The metal porous body is prepared by fusing a metal alloy comprising iron, nickel, copper and the like and dissolving a gas into the fused metal material, followed by cooling. It is a lightweight iron material and has a tensile strength comparable to non-porous iron materials, as well as a high strength. Therefore, it is expected to substitute for iron. However, the preparation process and the setting of conditions for the preparation process are complicated, and thus, industrialization thereof is not easy.

Accordingly, the present inventors have made extensive efforts to develop a substitute for the existing heavyweight stainless steels, and studies and, as a result, confirmed that, when lightweight iron is prepared using metallic minerals, or a mixture of metallic materials and non-metallic materials, the weight of the lightweight iron can be decreased by adding diamond or silicon carbide to form pores inside the iron body, and a lightweight iron having desired properties and effects can be prepared by controlling sintering temperature and addition ratio of diamond or silicon carbide in the preparation process, thereby completing the present invention.

SUMMARY OF INVENTION

Thus, it is an object of the present invention to provide a porous lightweight iron as a substitute for the existing stainless steel and a method for preparing the same.

To achieve the above object, the present invention provides a method for preparing a porous lightweight iron, which comprises the steps of (a) pulverizing a metallic mineral; (b) mixing 100 parts by weight of the pulverized product obtained in the step (a) with 2 to 20 parts by weight of diamond or silicon carbide; (c) sintering the mixture obtained in the step (b) in a sintering furnace at a temperature of 1100 to 1400° C. for 2 to 5 hours; and (d) obtaining the resulting porous lightweight iron after completion of the sintering.

The present invention also provides a method for preparing a porous lightweight iron, which comprises the steps of (a) mixing 100 parts by weight of molten pig iron from a blast furnace with 2 to 10 parts by weight of silicon carbide; (b) sintering the mixture obtained in the step (a) in a sintering furnace at a temperature of 1100 to 1400° C. for 2 to 5 hours; and (c) obtaining the resulting porous lightweight iron, after completion of the sintering.

The present invention also provides a porous lightweight iron, which is prepared by the method and has a weight per unit volume of 10 to 65% (w/v) compared to the existing stainless steel.

Other features and embodiments of the present invention will be more apparent from the following detailed description and the appended claims.

DETAILED DESCRIPTION OF THE INVENTION AND PREFERRED EMBODIMENTS

Figure 1:
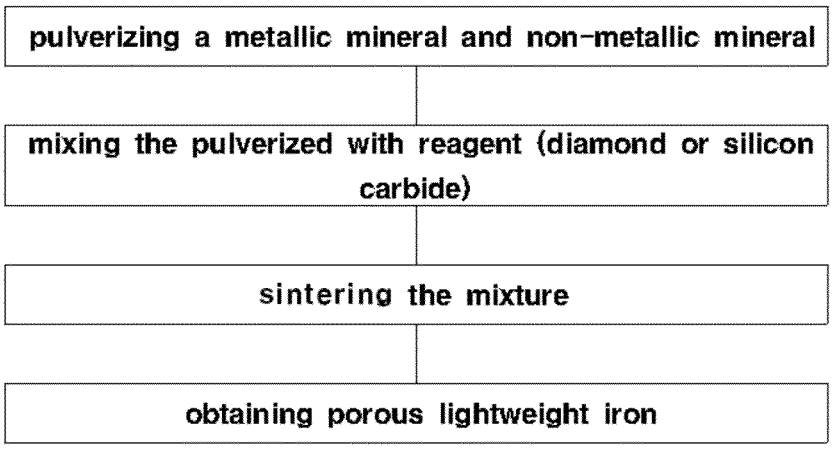
FIG. 1 is a flow chart showing a process for preparing the porous lightweight iron according to the present invention.

In one aspect, the present invention relates to a method for preparing a porous lightweight iron, which comprises the steps of (a) pulverizing a metallic mineral; (b) mixing 100 parts by weight of the pulverized product of the step (a) with 2 to 20 weight parts of diamond or silicon carbide; (c) sintering the mixture from the step (b) in a furnace at a temperature of 1100 to 1400° C. for 2 to 5 hours; and (d) obtaining the resulting porous lightweight iron after completing the sintering (FIG. 1).

In the present invention, a non-metallic mineral may preferably be added and pulverized together with the metallic mineral in the step (a), wherein the non-metallic mineral is preferably added in an amount of 2 to 150 weight parts, based on 100 parts by weight of the metallic minerals.

In the present invention, the metallic mineral includes at least one selected from the group consisting of iron ore, scheelite, ilmenite, rhodochrosite, lead ore, zinc ore, stainless steel, nickel, chromium, cast iron, scrap iron, Molybdenum ore, tungsten, zirconium ore and iron sulfide.

In the present invention, the non-metallic mineral includes at least one selected from the group consisting of zeolite, bentonite, limestone, silica sand, dolomite, bauxite, silica stone and fluorite.

Generally, the non-metallic mineral has a low thermal conductivity, and thus, can endure high temperature for a long period of time. Therefore, when the lightweight iron prepared using such non-metallic minerals is applied to building structures, it is expected to show excellent fire resistance.

The metallic minerals and the non-metallic mineral can be selected from the above mentioned minerals according to the intended use of the final lightweight iron.

Also, the lightweight iron according to the present invention should be prepared to have decreased weight as well as a strength strong enough to substitute for the existing steel products. Therefore, it can be prepared using minerals, particularly, metallic minerals alone or in combination with non-metallic minerals.

In the present invention, diamond or silicon carbide is preferably used as an additive to form pores in the porous lightweight iron. They are non-toxic minerals, melt only at a high temperature, and form pores during the sintering process, thus resulting in the effect of producing the resulting lightweight iron.

Meanwhile, when diamond or silicon carbide is added in an amount of less than 2 parts by weight, based on 100 parts by weight of the metallic mineral or 100 parts by weight of the mixture of the metallic mineral and the non-metallic mineral, pores cannot be sufficiently formed and thus the effect of lightweight iron cannot be achieved. When diamond or silicon carbide is added in an amount of more than 20 parts by weight, based on 100 parts by weight of the metallic mineral or 100 parts by weight of the mixture of the metallic mineral and the non-metallic mineral, excessive pores are formed, thus impairing the properties of the resulting lightweight iron. Therefore, the amount of diamond or silicon carbide used in the preparation of the lightweight iron is preferably 2 to 20 parts by weight, based on 100 parts by weight of the metallic mineral or 100 parts by weight of the mixture of the metallic mineral and the non-metallic mineral.

The method for preparing the porous lightweight iron according to the present invention includes a sintering process, in which if the sintering temperature is less than 1100° C., the sintering time is lengthened. If the temperature exceeds 1400° C., although the sintering time is shortened, the pore size becomes so big that the strength of the resulting lightweight iron is deteriorated. Also, when the sintering time is less than 2 hours, the size of the pores formed inside the iron is small, and when the sintering time exceeds 5 hours, the number of the pores is reduced, whereby the effect of lightweight iron cannot be achieved. Therefore, in the present invention, the sintering temperature and the sintering time of the sintering process is preferably 1100 to 1400° C. and 2 to 5 hours, respectively.

Meanwhile, due to the pores formed in the sintering process, the volume of the lightweight iron is increased. The increased volume of the resulting lightweight iron is 1.5 to 9 times the original volume. However, when the volume is increased excessively, the prepared lightweight iron cannot be used for the desired purpose. Therefore, in order to prevent such an excessive volume increase, volume of the lightweight iron during the sintering process can be controlled. That is, in order to reduce the extent of volume increase during the sintering process, the sintering temperature is set to the maximum temperature, at which the lightweight iron is not deformed and maintains its original properties, then the sintering process is performed for 20 minutes to 1 hour at that temperature.

Figure 2:
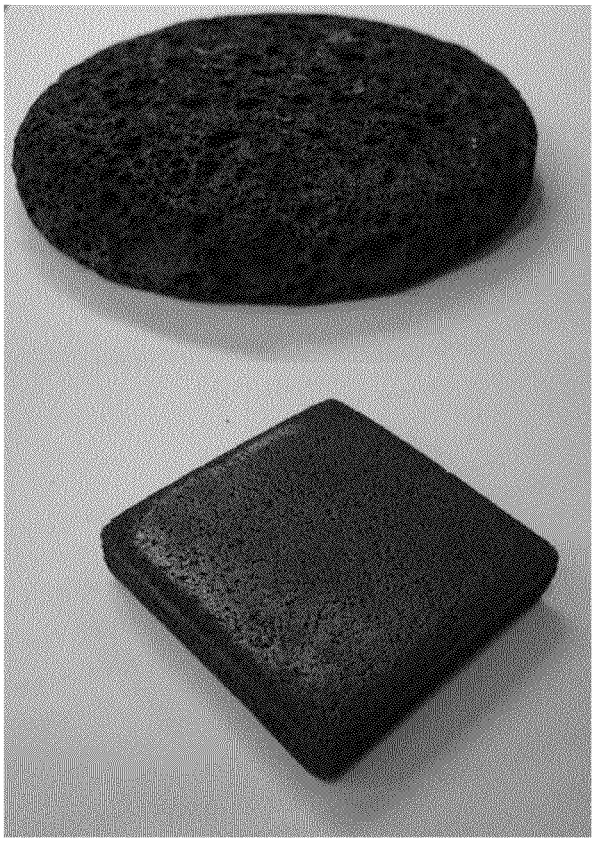
FIG. 2 is a photograph of the porous lightweight iron having various shapes, prepared by the method according to the present invention, using metallic minerals and diamond or silicon carbide.

In another aspect, the present invention relates to a porous lightweight iron prepared by the method described above (FIG. 2). In the present invention, the porous lightweight iron preferably has a pore size of 0.1 to 1 cm. The pore size is closely related with the temperature of the sintering process. That is, if the temperature in a furnace is slowly increased, the pore size is small and the size distribution is uniform, while if the temperature is rapidly increased, the pore size is big and the size distribution is not uniform.

In the present invention, the porous lightweight iron has a weight per unit volume of 10 to 65 kg (w/v), whereas the general steel has a weight per unit volume of 100 kg, and thus, it is suggested that the porous lightweight iron according to the present invention has a weight of 10 to 65% weight, compared to the existing steel having the same volume. Furthermore, the porous lightweight iron according to the present invention can have 10 to 90% weight, compared to the steel having the same volume, according to the mixing ratio of raw materials used for its preparation.

The porous lightweight iron has a high packing density, and has excellent compressive strength since it is completely sintered through the sintering process at the high temperature. Also, it has excellent fire resistance since the pores are formed in the sintering process at the high temperature, and has a weight of about 1/20 of the weight of sand having the same volume due to the porosity. Further, the porous lightweight iron can act as an excellent latent heat storage due to the pores formed therein and thus can prevent heat loss, and it shows excellent heat insulation delays heat transmission when a fire occurred to provide escape time, thus making it possible to have the effect of reducing loss of life. In addition, since the porous lightweight iron has decreased weight, it is possible to reduce production costs when applied to an actual industry.

In yet another aspect, the present invention relates to a method for preparing a porous lightweight iron, which comprises the steps of: (a) mixing 100 parts by weight of molten pig iron a blast furnace with 2 to 10 parts by weight of silicon carbide; (b) sintering the mixture obtained in the step (a) in a sintering furnace at a temperature of 1100 to 1400° C. for 2 to 5 hours; and (c) obtaining the resulting porous lightweight iron, after the completion of the sintering.

According to the present invention, the molten pig iron from the blast furnace has a temperature of 1000 to 2000° C. When the temperature of the molten pig iron is less than 1000° C., the reaction with silicon carbide is not sufficient. When it exceeds 2000° C., there is no benefit according to the increase in the processing temperature.

In the present invention, the step (a) is preferably performed for 1 to 8 minutes. When the reaction time is less than 1 minute, the molten pig iron fails to sufficiently react with silicon carbide, and when it exceeds 8 minutes, there is no benefit according to at the cost of the increase in the processing time.

When the sintering temperature is less than 1100° C., the sintering time is lengthened. When the temperature exceeds 1400° C., although the sintering time can be reduced, the size of the pores formed in the iron is excessively big, whereby the strength of the porous lightweight iron is reduced. Also, when the sintering time is less than 2 hours, the size of the pores formed in the iron is small. When the sintering time exceeds 5 hours, the number of the pores is reduced, whereby it is impossible to achieve the effect of lightweight iron. Therefore, in the sintering step of the method according to the present invention, the sintering temperature and the sintering time is preferably 1100 to 1400° C. and 2 to 5 hours, respectively.

EXAMPLES

Hereinafter, the present invention will be described in further detail with reference to examples. It is to be understood, however, that these examples are for illustrative purposes only and are not to be construed to limit the scope of the present invention.

Example 1

Preparation of Porous Lightweight Iron Using Iron Ore, Zeolite and Diamond

The porous lightweight iron was prepared using iron ore as a metallic mineral, zeolite as a non-metallic mineral and diamond. 96 kg of iron ore and 2 kg of zeolite were pulverized to a particle size of 50 to 120 mesh and mixed with 2 kg of diamond by using a blender. The mineral mixture was sintered at a temperature of 1200° C. for 5 hours in a sintering furnace to obtain the porous lightweight iron.

Example 2

Preparation of Porous Lightweight Iron Using Iron Ore, Bentonite and Diamond The porous lightweight iron was prepared using iron ore as a metallic mineral, bentonite as a non-metallic mineral and diamond. 90 kg of iron ore and 5 kg of bentonite were pulverized to a particle size of 50 to 120 mesh and mixed with 5 kg of diamond by using a blender. The mineral mixture was sintered at a temperature of 1180° C. for 5 hours in a sintering furnace to obtain the porous lightweight iron.

Example 3

Preparation of Porous Lightweight Iron Using Iron Ore, Zeolite and Diamond

The porous lightweight iron was prepared using iron ore as a metallic mineral, zeolite as a non-metallic mineral and diamond. 80 kg of iron ore and 10 kg of zeolite were pulverized to a particle size of 50 to 120 mesh and mixed with 10 kg of diamond by using a blender. The mineral mixture was sintered at a temperature of 1250° C. for 4 hours in a sintering furnace to obtain the porous lightweight iron.

Example 4

Preparation of Porous Lightweight Iron Using Iron Ore, Zeolite, Limestone and Diamond The porous lightweight iron was prepared using iron ore as a metallic mineral, zeolite and limestone as non-metallic minerals, and diamond. 70 kg of iron ore, 20 kg of zeolite and 5 kg of limestone were pulverized to a particle size of 50 to 120 mesh and mixed with 5 kg of diamond by using a blender. The mineral mixture was sintered at a temperature of 1150° C. for 3 hours in a sintering furnace to obtain the porous lightweight iron.

Example 5

Preparation of Porous Lightweight Iron Using Iron Ore and Diamond

The porous lightweight iron was prepared using iron ore as a metallic mineral and diamond. 90 kg of iron ore was pulverized to a particle size of 50 to 120 mesh and mixed with 10 kg of diamond by using a blender. The mineral mixture was sintered at a temperature of 1350° C. for 3 hours in a sintering furnace to obtain the porous lightweight iron.

Example 6

Preparation of Porous Lightweight Iron Using Iron Ore, Zeolite, $SiO_2$, Limestone and Diamond The porous lightweight iron was prepared using iron ore as a metallic mineral, zeolite, $SiO_2$ and limestone as non-metallic minerals, and diamond. 65 kg of iron ore, 22 kg of zeolite, 4 kg of $SiO_2$ and 4 kg of limestone were pulverized to a particle size of 80 to 120 mesh and mixed with 5 kg of diamond by using a blender. The mineral mixture was sintered at a temperature of 1100° C. for 3 hours in a sintering furnace to obtain the porous lightweight iron.

Example 7

Preparation of Porous Lightweight Iron Using Scrap Iron, Zeolite and Diamond The porous lightweight iron was prepared using scrap iron as a metallic mineral, zeolite as a non-metallic mineral and diamond. 96 kg of scrap iron and 2 kg of zeolite were pulverized to a particle size of 50 to 120 mesh and mixed with 2 kg of diamond by using a blender. The mineral mixture was sintered at a temperature of 1200° C. for 4 hours in a sintering furnace to obtain the porous lightweight iron.

Experimental Example 1

Comparison of Weights Between the Porous Lightweight Iron of the Present Invention and Existing Iron Steel The weight of each porous lightweight iron prepared in Example 1 to Example 7 was compared with that of the existing iron steel which was prepared using 100% iron. Each the porous lightweight and the iron steel was measured for their weight per unit volume using a weight measurement device.

As a result, the iron steel had 100 kg of a weight per unit volume and each porous lightweight iron prepared in Examples 1-7 had 38 to 56 kg of a weight per unit volume, as shown in Table 1, which was 38 to 56% of the weight per unit volume of the iron steel. Therefore, it was confirmed that the porous lightweight irons according to the present invention was lighter than the existing iron steel.

TABLE 1

| Example | Metallic mineral | Non-metallic mineral | Diamond or silicon carbide | Sintering time (h) | Sintering temp. (° C.) | weight per unit volume (kg) |
|---|---|---|---|---|---|---|
| 1 | iron ore 96 kg | zeolite 2 kg | diamond 2 kg | 4 | 1200 | 52 |
| 2 | iron ore 90 kg | bentonite 5 kg | diamond 5 kg | 5 | 1180 | 48 |
| 3 | iron ore 80 kg | zeolite 10 kg | diamond 10 kg | 4 | 1250 | 46 |
| 4 | iron ore 70 kg | zeolite 20 kg limestone 5 kg | diamond 5 kg | 3 | 1150 | 47 |
| 5 | iron ore 90 kg | — | diamond 10 kg | 3 | 1350 | 43 |
| 6 | iron ore 65 kg | zeolite 22 kg $SiO_2$ 4 kg limestone 4 kg | diamond 5 kg | 3 | 1100 | 38 |
| 7 | scrap iron 96 kg | zeolite 2 kg | diamond 2 kg | 4 | 1200 | 56 |

Example 8

Preparation of Porous Lightweight Iron Using Molten Pig Iron and Silicon Carbide The porous lightweight iron was prepared using molten pig iron from a blast furnace and silicon carbide. 100 kg of the molten pig iron heated at a temperature of 1500° C. in the furnace was mixed with 6 kg of silicon carbide powder for 5 minutes. The mixture was sintered at a temperature of 1250° C. for 4 hours in a sintering furnace to obtain the porous lightweight iron.

Experimental Example 2

Comparison of Weights Between the Porous Lightweight Iron of Example 8 and Existing Iron Steel The weight of porous lightweight iron prepared in Example 8 was compared with that of the iron steel which was prepared using 100% iron. Each the porous lightweight iron and the iron steel was measured for their weight per unit volume using a weight measurement device.

Figure 3:
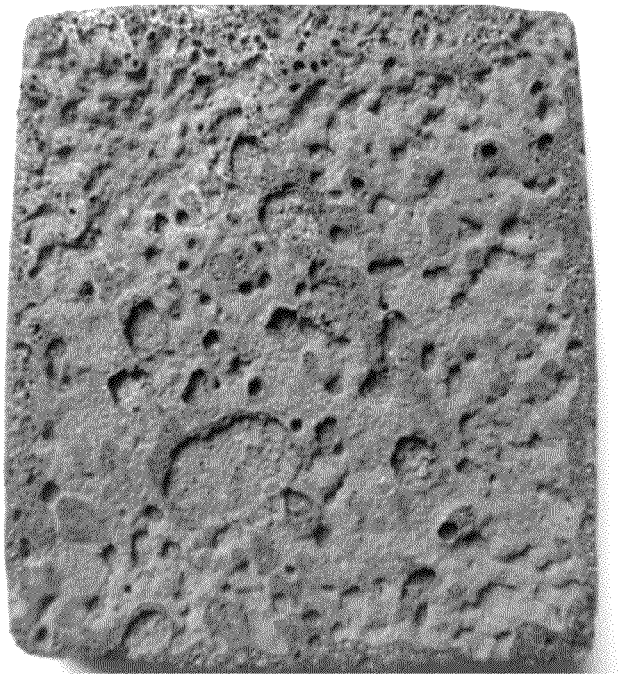
FIG. 3 is a photograph of the porous lightweight iron, prepared by the method according to the present invention, using molten pig iron and silicon carbide.

As a result, the iron steel had 100 kg of weight per unit volume and the porous lightweight iron prepared in Example 8 had 40 to 60 kg of weight per unit volume, which was 40 to 60% of weight per unit volume of the iron steel. Therefore, it was confirmed that the porous lightweight iron prepared in Example 8 was lighter than the existing iron steel (FIG. 3).

INDUSTRIAL APPLICABILITY

As described above in detail, according to the present invention, the thickness, weight and strength of lightweight iron to be produced, can be controlled, thus making it possible to prepare porous lightweight iron having desired properties by controlling the sintering temperature during the preparation process, the mixing ratio of diamond or silicon carbide and the mixing ratio of raw materials. Also, since the porous lightweight iron prepared according to the present invention has a weight per unit volume of 10 to 65% (W/V), compared to the existing iron steel products, it is possible to increase economic efficiency and improve processing convenience, when applied to an actual industry.

Although the present invention has been described in detail with reference to the specific features, it will be apparent to those skilled in the art that this description is only for a preferred embodiment and does not limit the scope of the present invention. Thus, the substantial scope of the present invention will be defined by the appended claims and equivalents thereof.

What is claimed is:

1. A method for preparing a porous lightweight iron, which comprises the steps of:

(a) adding 2 to 150 parts by weight of a non-metallic mineral to iron ore based on 100 parts by weight of the iron ore, wherein the non-metallic mineral is at least one non-metallic mineral selected from the group consisting of zeolite, bentonite, limestone, silica sand, dolomite, bauxite, silica stone, and fluorite;

(b) pulverizing the iron ore and the non-metallic mineral together;

(c) mixing 100 parts by weight of the pulverized product obtained in the step (b) with 2 to 20 parts by weight of diamond;

(d) sintering the mixture obtained in the step (c) in a sintering furnace at a temperature of 1100 to 1400° C. for 2 to 5 hours; and (e) obtaining the resulting porous lightweight iron after the completion of the sintering.

* * * * *